US007307922B2

(12) United States Patent
Hiraya

(10) Patent No.: US 7,307,922 B2
(45) Date of Patent: Dec. 11, 2007

(54) STOPWATCH AND WATCH

(75) Inventor: Eiichi Hiraya, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 183 days.

(21) Appl. No.: 10/855,971

(22) Filed: May 28, 2004

(65) Prior Publication Data

US 2005/0041535 A1 Feb. 24, 2005

(30) Foreign Application Priority Data

May 30, 2003 (JP) ..... 2003-155878

(51) Int. Cl.
*G04B 1/00* (2006.01)
*G04B 1/10* (2006.01)

(52) U.S. Cl. ..... 368/204; 368/140

(58) Field of Classification Search ..... 368/100–106, 368/62, 69, 76, 87, 140
See application file for complete search history.

(56) References Cited

U.S. PATENT DOCUMENTS

| | | | | |
|---|---|---|---|---|
| 5,113,381 | A * | 5/1992 | Sakamoto et al. | 368/74 |
| 5,339,293 | A * | 8/1994 | Kamiyama et al. | 368/21 |
| 6,466,518 | B1 * | 10/2002 | Akahane et al. | 368/64 |
| 6,894,951 | B1 * | 5/2005 | Brandt et al. | 368/80 |
| 2002/0006080 | A1 * | 1/2002 | Shimizu et al. | 368/73 |
| 2002/0064099 | A1 * | 5/2002 | Wyssbrod et al. | 368/113 |
| 2002/0191493 | A1 | 12/2002 | Hara | |
| 2003/0090962 | A1 * | 5/2003 | Tu et al. | 368/124 |
| 2004/0004909 | A1 * | 1/2004 | Fujimori | 368/204 |
| 2004/0233788 | A1 * | 11/2004 | Plancon et al. | 368/11 |

FOREIGN PATENT DOCUMENTS

| | | | |
|---|---|---|---|
| JP | 1152078 | A | 2/1999 |
| JP | 11258367 | A | 9/1999 |
| JP | 2001186719 | A | 7/2001 |
| JP | 2002262482 | A | 9/2002 |

* cited by examiner

*Primary Examiner*—Vit Miska
*Assistant Examiner*—Thanh S. Phan
(74) *Attorney, Agent, or Firm*—Global IP Counselors, LLP

(57) ABSTRACT

A timepiece having basic timepiece pointers, chronograph information pointers, a mechanical energy storage section, a train wheel, a power generator, and a control section. The basic timepiece pointers are rotated to indicate the standard time. The chronograph information pointers are rotated to indicate chronograph information. The mechanical energy storage section includes a mainspring. The train wheel is disposed between the mechanical energy storage section and the pointers, and transmits energy from the mechanical energy storage section to the pointers. The power generator has a rotating rotor connected to the train wheel, and generates electric power upon receiving the energy from the mechanical energy storage section. The control section is energized by the electric power produced by the power generator, and controls the rotation cycle of the rotor.

22 Claims, 11 Drawing Sheets

STOPWATCH AND WATCH

BACKGROUND OF THE INVENTION

1. Field of the Invention

The present invention relates to a stopwatch and a timepiece including a chronograph function.

2. Description of the Related Art

Multifunction timepieces that include pointers for a chronograph, an alarm, or the like in addition to an hour hand, minute hand, second hand, and other such basic timepiece pointers for indicating the standard time are known in conventional practice as mechanical timepieces with a mainspring drive.

In such multifunction timepieces, the seconds chronograph hand ("chronograph" is hereinafter abbreviated as "CG") disposed in the middle of the dial, for example, is mounted on a second CG wheel concentric with a seconds wheel and pinion, and is continually driven by the seconds wheel and pinion via a reversing mechanism with detachable gears configured from a reversing plate, a reversing ring, a chronograph coupling lever, and the like (for example, Japanese Laid-Open Patent Application No. 11-258367). Also, the oscillation frequency of the balance (number of oscillations per second) for determining the speed of the mechanical timepiece is generally six, eight, or ten oscillations, and is usually six.

However, when the oscillation frequency of the balance is six oscillations, the smallest unit in the chronograph display is ⅙ seconds, but many specifications provide for graduations on the dial that are actually ⅕ seconds, which results in a problem in that the indicating tip of the second CG hand does not line up with the graduations and the chronograph time cannot be accurately measured.

Six, eight, and ten oscillations all have problems in that when the specifications for the oscillation frequency are determined, the minimum measurable units are set, making it impossible to make a more precise measurement. This problem is not limited to mechanical timepieces and also occurs in quartz timepieces. In other words, specifications are determined for the frequency of a motor pulse outputted to the chronograph stepping motor, and the minimum measurable units are thus set.

The speed of a mechanical timepiece is adjusted by intermittently, not continuously, driving a basic timepiece train wheel by means of a balance, a pallet, and an escape wheel and pinion. Specifically, when the pallet that vibrates in a reciprocating rocking movement collides with the escape wheel and pinion from one direction, the movement speed becomes zero for an instant due to the changeover to the other direction, so the basic timepiece train wheel instantaneously stops and is driven intermittently.

However, when the basic timepiece train wheel is intermittently driven so as to stop for an instant in a state wherein the reversing ring of the reversing mechanism is in contact with the reversing plate, the driving of the second CG hand by the seconds wheel and pinion is performed by overcoming static friction every time, which causes a problem in that friction and slipping tend to repeatedly occur between the seconds wheel and pinion and the reversing plate, and friction is induced between the reversing ring and reversing plate.

Also, when driving and stopping are repeated instantaneously in an alternating manner, the basic timepiece train wheel experiences the effects of an impact on the timepiece, and the pointers may be reversed depending on the degree of the impact, and hence move in a nonuniform manner. As a result, when the second CG hand or the like moves and the time is read during heavy activity, the nonuniformity in pointer movement makes the precise values difficult to read.

It will be clear to those skilled in the art from the disclosure of the present invention that an improved multifunction timepiece is necessary because of the above-mentioned considerations. The present invention meets the requirements of these conventional technologies as well as other requirements, which will be apparent to those skilled in the art from the disclosure hereinbelow.

SUMMARY OF THE INVENTION

The timepiece relating to the present invention has basic timepiece pointers, chronograph information pointers, a mechanical energy storage section, a train wheel, a power generator, and a control section. The basic timepiece pointers are provided in order to rotate and to indicate the standard time. The chronograph information pointers are provided in order to rotate and to indicate chronograph information. The mechanical energy storage section contains a mainspring. The train wheel is disposed between the mechanical energy storage section and both sets of pointers, and transmits energy from the mechanical energy storage section to the pointers. The power generator has a rotor that is connected to the train wheel, rotated, and caused to generate power upon receiving energy from the mechanical energy storage section. The control section is driven by the electric power produced by the power generator, and controls the rotation cycle of the rotor.

The stopwatch relating to the present invention has chronograph information pointers, a mechanical energy storage section, a train wheel, a power generator, and a control section. The chronograph information pointers are provided to rotate to indicate chronograph information. The mechanical energy storage section contains a mainspring. The train wheel is disposed between the mechanical energy storage section and both sets of pointers, and transmits energy from the mechanical energy storage section to the pointers. The power generator has a rotor that is connected to the train wheel and that rotates, and generates power upon receiving energy from the mechanical energy storage section. The control section is driven by the electric power produced by the power generator and is adapted to control the rotation cycle of the rotor.

The objects, characteristics, merits, and other attributes of the present invention described above shall be clear to those skilled in the art from the description of the invention hereinbelow. The description of the invention and the accompanying diagrams disclose the preferred embodiments of the present invention.

BRIEF DESCRIPTION OF THE DRAWINGS

Referring to the accompanying diagrams, which partially disclose the present invention.

DESCRIPTION OF THE PREFERRED EMBODIMENTS

Embodiments of the invention will now be described with reference to the drawings. As will be apparent from the disclosure of the present invention to those skilled in the art, the description of the invention embodiments is intended solely to illustrate the present invention and should not be construed as limiting the scope of the present invention, which is defined by the claims described below or by equivalent claims thereof.

[Basic Structure of Multifunction Timepiece]

Figure 1:
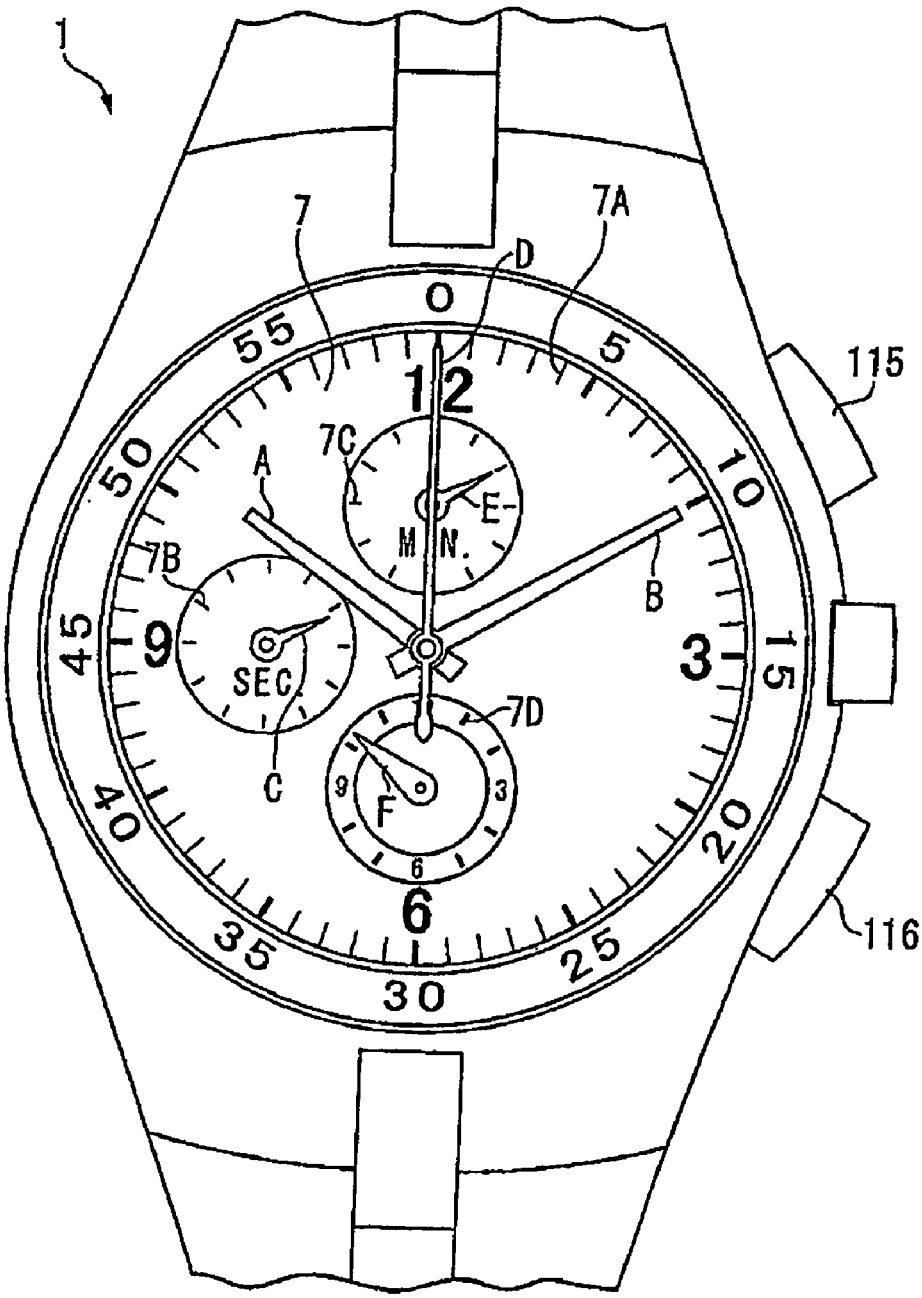
FIG. 1 is an external front view of a multifunction timepiece included in a series of timepieces relating to the first embodiment of the present invention.

In FIG. 1, the multifunction timepiece 1 includes an hour hand (basic timepiece pointer) A, minute hand (basic timepiece pointer) B, and second hand (basic timepiece pointer) C for displaying the standard time, and a second CG hand (secondary time information pointer) D, minute CG hand E, and hour CG hand F for displaying CG time, which is information other than the standard time.

The hour hand A, minute hand B, and second hand C rotate around the center of the dial 7, and point to graduations 7A provided along the outer periphery of the dial 7. The second hand C rotates so as to point to graduations 7B of a 60-second timer provided to the 9:00 area of the dial 7. The minute CG hand E rotates so as to point to graduations 7C of a 60-minute timer provided to the 12:00 area. The hour CG hand F rotates so as to point to graduations 7D of a 12-hour timer provided to the 6:00 area.

However, the positions of these graduations 7B, 7C, and 7D are not limited to this option alone and may be arbitrarily determined in an actual implementation.

Figure 2:
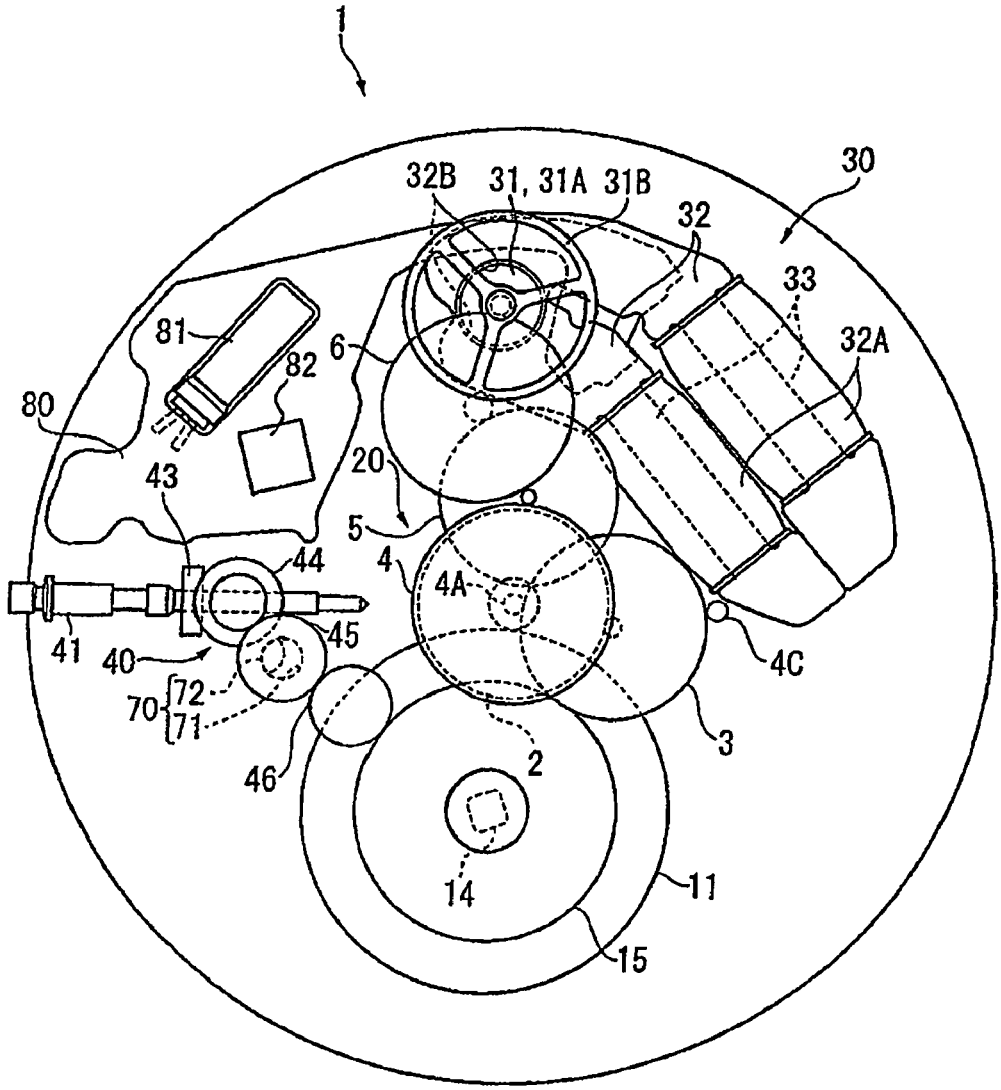
FIG. 2 is a plan view showing the basic outline of the first layer of a movement for a multifunction timepiece.
Figure 3:
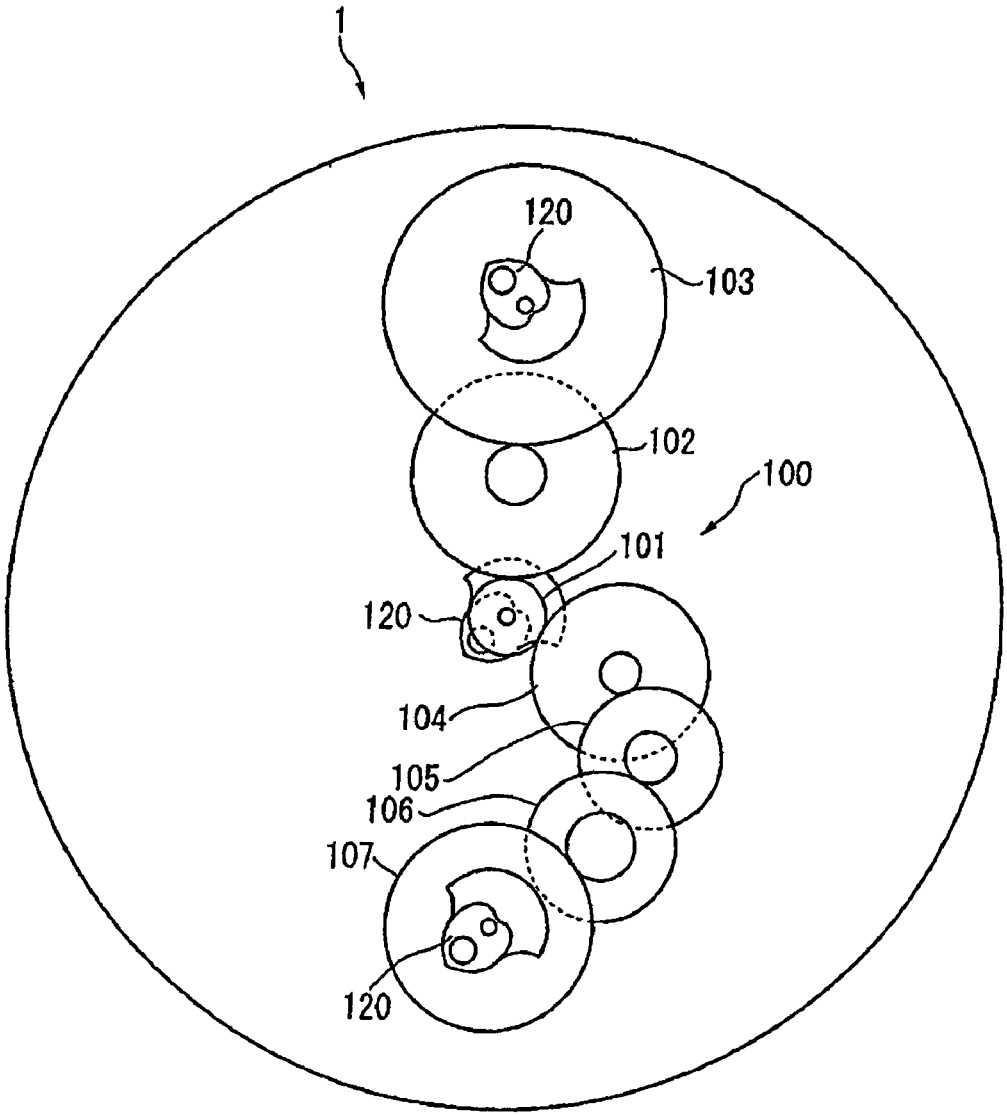
FIG. 3 is a plan view showing the basic outline of the second layer of the movement.
Figure 4:
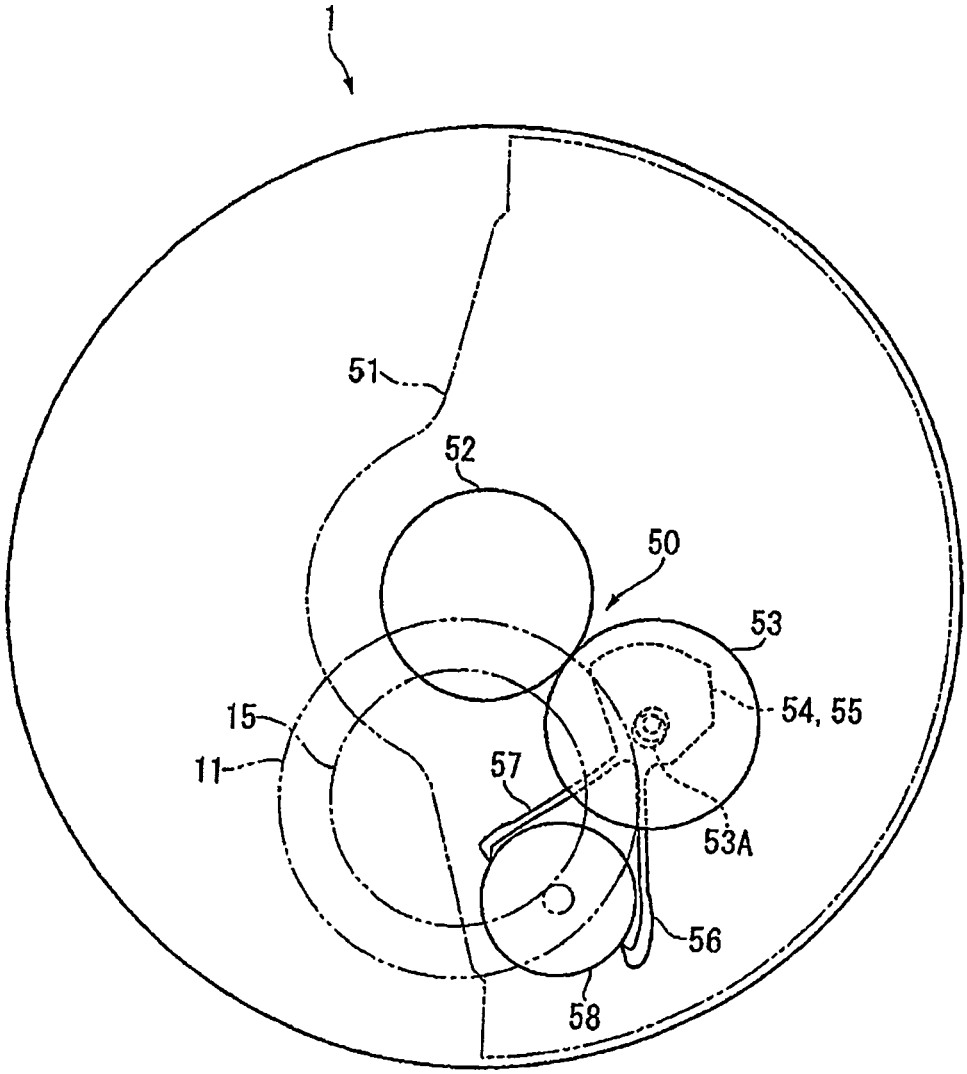
FIG. 4 is a plan view showing the basic outline of the third layer of the movement.

In such a multifunction timepiece 1, a basic timepiece train wheel 20 (hereinafter occasionally abbreviated as "train wheel 20") is disposed in the first layer near the dial 7 as shown in FIG. 2, a CG train wheel 100 is disposed in the second layer on the top thereof so as to be separated from the dial 7 as shown in FIG. 3, and an automatic input mechanism 50 is disposed in the third layer on the top thereof as shown in FIG. 4.

[Description of First Layer]

Figure 5:
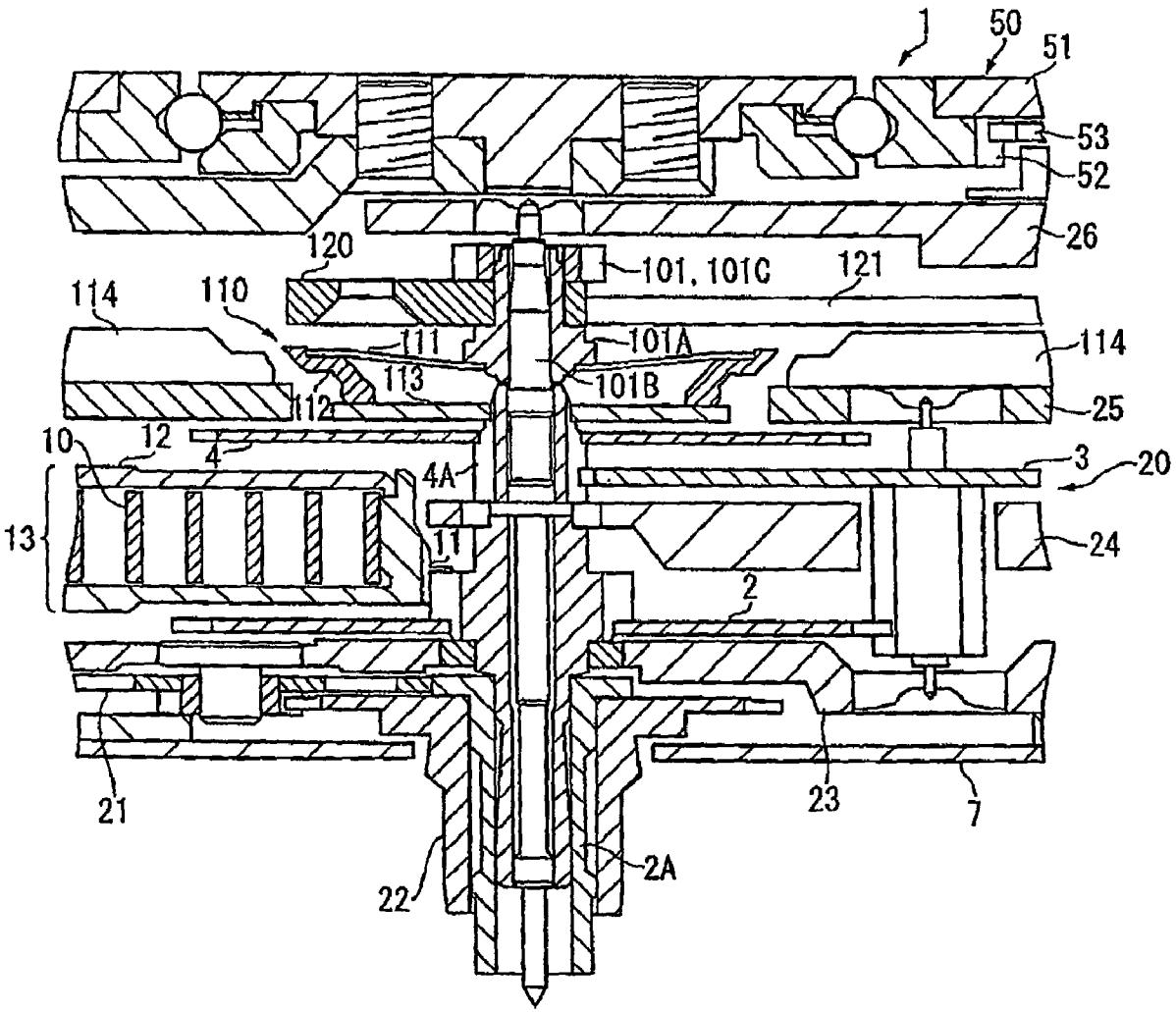
FIG. 5 is a cross-sectional view showing the main section of the movement.

In FIGS. 2 and 5, the multifunction timepiece 1 is an electronically controlled mechanical timepiece wherein the basic timepiece train wheel 20 is driven with a mainspring 10 (mechanical energy storage device) as a mechanical energy source, electric power is produced in a power generator 30 that rotates upon receiving the rotation from the train wheel 20, and the rotation cycle of the power generator 30 is controlled by an electronic circuit (not shown) energized by this electric power, whereby the speed is adjusted while damping is applied to the train wheel 20, and the train wheel 20 is continuously rotated in a constant direction. The timepiece includes a manual input mechanism 40 for manually winding the mainspring 10 and inputting mechanical energy, and the automatic input mechanism 50 for automatic winding and input.

The mainspring 10 is accommodated in a barrel 13 including a barrel gear 11 and a barrel lid 12, the inner edge is fixed to a barrel stem 14, and the outer edge is fixed to or guided along the inner surface of the barrel gear 11 with a sliding mechanism. Also, a ratchet wheel 15 is mounted on the barrel stem 14, and the ratchet wheel 15 is made to rotate in one direction by the manual input mechanism 40 or the automatic input mechanism 50, whereby the barrel stem 14 is rotated and the mainspring 10 is wound up. Conversely, the mainspring 10 is wound back (loosened) from the outer edge, whereby the barrel gear 11 is rotated, the interlocking train wheel 20 is actuated, and electric power is produced in the power generator 30.

The basic timepiece train wheel 20 includes a center wheel and pinion 2 that interlocks with the barrel gear 11, as well as a third wheel and pinion 3, a seconds wheel and pinion 4, a fifth wheel and pinion 5, and a sixth wheel and pinion 6 interlocked so as to increase in speed in the order indicated. A small seconds wheel 4C interlocks with the third wheel and pinion 3, and the second hand C (FIG. 1) is mounted on the small seconds wheel 4C. Also, the minute hand B (FIG. 1) is mounted on a cannon pinion 2A of the center wheel and pinion 2, and the hour hand A (FIG. 1) is mounted on an hour wheel 22 to which the rotation of the cannon pinion 2A is transmitted via a minute wheel 21. The lower end of the center wheel and pinion 2 in FIG. 5 is axially supported on a main plate 23, and the upper end is axially supported on a center bridge 24. The pivoting sections of the lower ends of the third wheel and pinion 3, fifth wheel and pinion 5, and sixth wheel and pinion 6 are axially supported on the main plate 23, and the pivoting sections of the upper ends are axially supported on a train wheel bridge 25. The seconds wheel and pinion 4 is made hollow and is rotatably disposed on the center bridge 24 with a seconds pinion 4A. A second CG wheel (a wheel on which pointers for other information are mounted) 101 is inserted through the seconds wheel and pinion 4 and the center wheel and pinion 2.

The power generator 30 includes a rotor 31 interlocking with the sixth wheel and pinion 6 of the train wheel 20, a stator 32 for forming a magnetic circuit by interlinking the magnetic fluxes of permanent magnets 31A in the rotor 31, and a pair of coils 33 wound around a pair of stator members 32A constituting the stator 32 and designed for converting the flux variations in the stator members 32A produced by the rotation of the permanent magnets 31 A into electric power. The coils 33 are electrically connected to a circuit block (electronic component) 80 on which is formed an electronic circuit for pointer movement control including a crystal oscillator 81 and an IC (control device: electronic component) 82, the electronic circuit is energized by the electric power generated by the power generator 30, speed is adjusted while the rotor 31 is damped and the train wheel 20 is continuously rotated in a constant direction, and the pointer movement is controlled without setting the drive speed of the train wheel 20 to zero. In other words, the power generator 30 and the IC 82 constitute a speed adjustment device. The rotor 31 includes an integrally rotating inertia plate 31 B and is disposed in a rotor-accommodating hole 32B formed in the stator 32. The circuit block 80 is an FPC (flexible printed circuit) that uses a polyimide film or another such resinous film. The IC 82 is hereinafter described in detail.

The manual input mechanism 40 is configured to allow the mainspring 10 to be wound using a setting stem 41. Specifically, an integrally rotating clutch wheel (not shown) is inserted through the setting stem 41, and in a normal state when the setting stem 41 is not pulled out, the rotation of the setting stem 41 is transmitted to the clutch wheel and is then transmitted from the clutch wheel to a winding pinion 43 similarly inserted through the setting stem 41. The rotation of the winding pinion 43 is transmitted to an intermediate transmission wheel 45 via a crown wheel 44, and is then transmitted to the ratchet wheel 15 via a first transmission wheel 46 to wind up the mainspring 10. The manual input mechanism 40 is formed from components that range from the setting stem 41 to the first transmission wheel 46.

[Description of Second Layer]

In FIGS. 3 and 5, the CG train wheel 100 is provided to the second layer. The CG train wheel 100 includes the second CG wheel 101 on which the second CG hand D is mounted. This section has a stopwatch function.

A minute CG intermediate wheel 102 interlocks with the second CG wheel 101, and a minute CG wheel 103 interlocks with the minute CG intermediate wheel 102. These wheels 101 to 103 constitute a minute CG train wheel, which is a reduction train wheel, and when the second CG wheel 101 makes one rotation, the minute CG wheel 103 rotates 6 degrees and the minute CG hand E (FIG. 1) mounted on the minute CG wheel 103 indicates that one minute has passed. The minute CG wheel 103 may be a 30 minute timer, in which case the minute CG wheel 103 rotates 12 degrees to indicate that one minute has passed when the second CG wheel 101 makes one rotation.

Also, an hour CG first intermediate wheel 104 interlocks with the second CG wheel 101, an hour CG second intermediate wheel 105 interlocks with the hour CG first intermediate wheel 104, an hour CG third intermediate wheel 106 interlocks with the hour CG second intermediate wheel 105, and an hour CG wheel 107 interlocks with the hour CG third intermediate wheel 106. These wheels 101 and 104-107 constitute an hour CG train wheel that serves as a reduction train wheel, and when the second CG wheel 101 makes 60 rotations, the hour CG wheel 107 rotates 30 degrees and the hour CG hand F (FIG. 1) mounted on the hour CG wheel 107 indicates that one hour has passed.

The reduction ratio of the minute CG train wheel and the hour CG train wheel may be arbitrarily determined with consideration to the setting of the graduations 7C and 7D on the dial 7 (FIG. 1).

A detachable-gear reversing mechanism 110 is provided between the second CG wheel 101 and the seconds wheel and pinion 4 as shown in FIG. 5. The reversing mechanism 110 is configured with a spring member 111 mounted on the bush 101A of the second CG wheel 101, a circular reversing ring 112 mounted on the outer periphery of the spring member 111, a circular plate-shaped reversing plate 113 mounted on the seconds wheel and pinion 4 and kept in contact with the reversing ring 112, and a pair of chronograph coupling levers 114 for separating the reversing ring 112 from the reversing plate 113.

When the start and stop button 115 shown in FIG. 1 is pressed once, the chronograph coupling levers 114 move in separate directions away from the reversing ring 112, and the reversing ring 112 comes into contact with the reversing plate 113 due to the elasticity of the spring member 111. The rotation of the seconds wheel and pinion 4 normally induced thereby is transmitted to the second CG wheel 101 via the reversing plate 113, the reversing ring 112, and the spring member 111, causing the second CG hand D mounted on the second CG stem 101B of the second CG wheel 101 to rotate. The rotation of the second CG wheel 101 is transmitted via the minute CG train wheel and the hour CG train wheel, causing both the minute CG hand E and the hour CG hand F to rotate.

At this point, since the speed at which the train wheel 20 is driven does not become zero due to controlling the pointer movement by using the IC 82 and power generator 30, the seconds wheel and pinion 4 drives the second CG wheel 101 continuously and not intermittently while the reversing ring 112 is in contact with the reversing plate 113, and friction, slipping, and the like are unlikely to occur in the contact surface between the reversing plate 113 and the reversing ring 112. In such a configuration, the movement of the CG hands D, E, and F is not a stepping movement as in the case when a stepping motor is used, but is a so-called sweep movement with no slipping. It is apparent that the movement of the second hand C or the like mounted on the train wheel 20 is also a sweep movement.

Furthermore, when the start and stop button 115 is pressed again, the chronograph coupling levers 114 move back towards each other to come into contact with the reversing ring 112, and the reversing ring 112 is separated from the reversing plate 113 against the elasticity of the spring member 11. Thus, the driving force from the seconds wheel and pinion 4 is cut off, the CG train wheel 100 stops being driven, and the second CG hand D, the minute CG hand E, and the hour CG hand F stop rotating. At substantially the same time as the start and stop button 115 is operated to stop the CG train wheel 100, a regulating lever (not shown) comes into contact with the gear of the minute CG wheel 103, for example; another regulating lever (not shown) comes into contact with the gear of the hour CG wheel 107, for example; and the CG train wheel 100 is restricted in its movement.

The second CG wheel 101, the minute CG wheel 103, and the hour CG wheel 107 are provided with a flat heart-shaped resetting cam 120. In other words, a mechanical resetting device that uses the resetting cam 120 is employed in the present embodiment. To describe the structure of this section as typified by the second CG wheel 101 shown in FIG. 5, the resetting cam 120 rotates integrally with the second CG stem 101B via the bush 101A. Also, a slipping mechanism (not shown) is provided between the resetting cam 120 and the gear 101C of the second CG wheel, and it is possible to rotate the resetting cam 120, and consequently the second CG hand D mounted on the second CG stem 101B, even when the gear 101C has been stopped. The slipping mechanism may be provided to any of the intermediate wheels 102, 104, 105, and 106 in the CG train wheel 100.

In this configuration, when the CG train wheel 100 stops and the rotation thereof is restricted, the gear 101C also does not move but a hammer 121 is brought into contact with the resetting cam 120, whereby the resetting cam 120 slips and rotates relative to the gear 101C, and the second CG hand D is reset. This structure is the same for the minute CG wheel 103 or the hour CG wheel 107. The hammer 121 is provided so as to come into contact with all resetting cams 120, and is operated by pressing a reset button 116 shown in FIG. 1. The CG hands D, E, and F simultaneously reset when the hammer is operated once again. The symbol 26 in FIG. 5 is a CG train wheel bridge.

[Description of Third Layer]

In FIGS. 4 and 5, an automatic input mechanism 50 is provided in the third layer. The automatic input mechanism 50 includes an oscillating weight 51, an oscillating weight gear 52 that rotates integrally and concentrically with the oscillating weight 51, a first transmission wheel 53 made of iron-based material that rotates while interlocked with the oscillating weight gear 52, and a pawl lever 54 made of iron-based material that is driven in eccentric fashion in conjunction with the rotation of the first transmission wheel 53, and is thereby advanced and retracted to and from another transmission wheel 58, which is separate from the aforementioned transmission wheel 46. The pawl lever 54 includes a pawl lever main body 55 and elastically deformable pull pawl 56 and push pawl 57 that extend from the pawl lever main body 55. When the first transmission wheel 53 rotates, an eccentric axle 53A also rotates, and the pawl lever main body 55 engaged thereby is advanced and retracted in relation to the transmission wheel 58. When the pawl lever main body 55 reciprocates, the tips of the pull pawl 56 and push pawl 57 alternately engage and disengage from the radially oriented teeth of the transmission wheel 58.

Also, when the pawl lever main body 55 retracts from the transmission wheel 58, the pull pawl 56 engages the transmission wheel 58 and pulls the teeth of the transmission wheel 58 in this state. At this time, the push pawl 57 releases its engagement with the transmission wheel 58. When the pawl lever main body 55 advances toward the transmission wheel 58, the push pawl 57 engages the transmission wheel 58 and pushes on the teeth of the transmission wheel 58 in this state. Alternately repeating these operations causes the transmission wheel 58 to be intermittently rotated in one direction and the mainspring 10 to be wound up via the ratchet wheel 15.

When the transmission wheel 46 rotates due to the operation of the setting stem 41 of the manual input mechanism 40, and the transmission wheel 58 rotates in conjunction therewith, the pull pawl 56 and push pawl 57 are alternately deformed in elastic fashion and disengaged from the transmission wheel 58 due to the principles of a ratchet mechanism, and the first transmission wheel 53 and oscillating weight 51 (oscillating weight gear 52) do not rotate because of the operation of the setting stem 41.

Similarly, when the transmission wheel 58 is being rotated by the automatic input mechanism 50, a release device 70 for releasing the engagement between the intermediate transmission wheel 45 and transmission wheel 46 of the manual input mechanism 40 operates and keeps the setting stem 41 from rotating.

Although a detailed description thereof is omitted, the release device 70 is configured from a crown 71 provided roughly to the middle of the intermediate transmission wheel 45, a cross-sectional convex lens-shaped (single-lens) intermediate transmission axle 72 engaged in an interlocking fashion with the crown 71, and a disc spring-shaped holding member (not shown) for applying pressure to hold the intermediate transmission wheel 45 on a transmission support (not shown) along the axial direction. When the transmission wheel 58 is rotated by the automatic input mechanism 50, and the transmission wheel 46 rotates in conjunction therewith, the intermediate transmission wheel 45 and the transmission wheel 46 are automatically released from interlocking by a falcated gap formed between the crown 71 and the intermediate transmission axle 72, and not only is the rotation of the transmission wheel 46 not transmitted to only the intermediate transmission wheel 45, but it also is not transmitted to the crown wheel 44 and winding pinion 43 next to the setting stem 41 as well, and the process ends without the rotation of these members.

[Detailed Description of Control Device]

Figure 6:
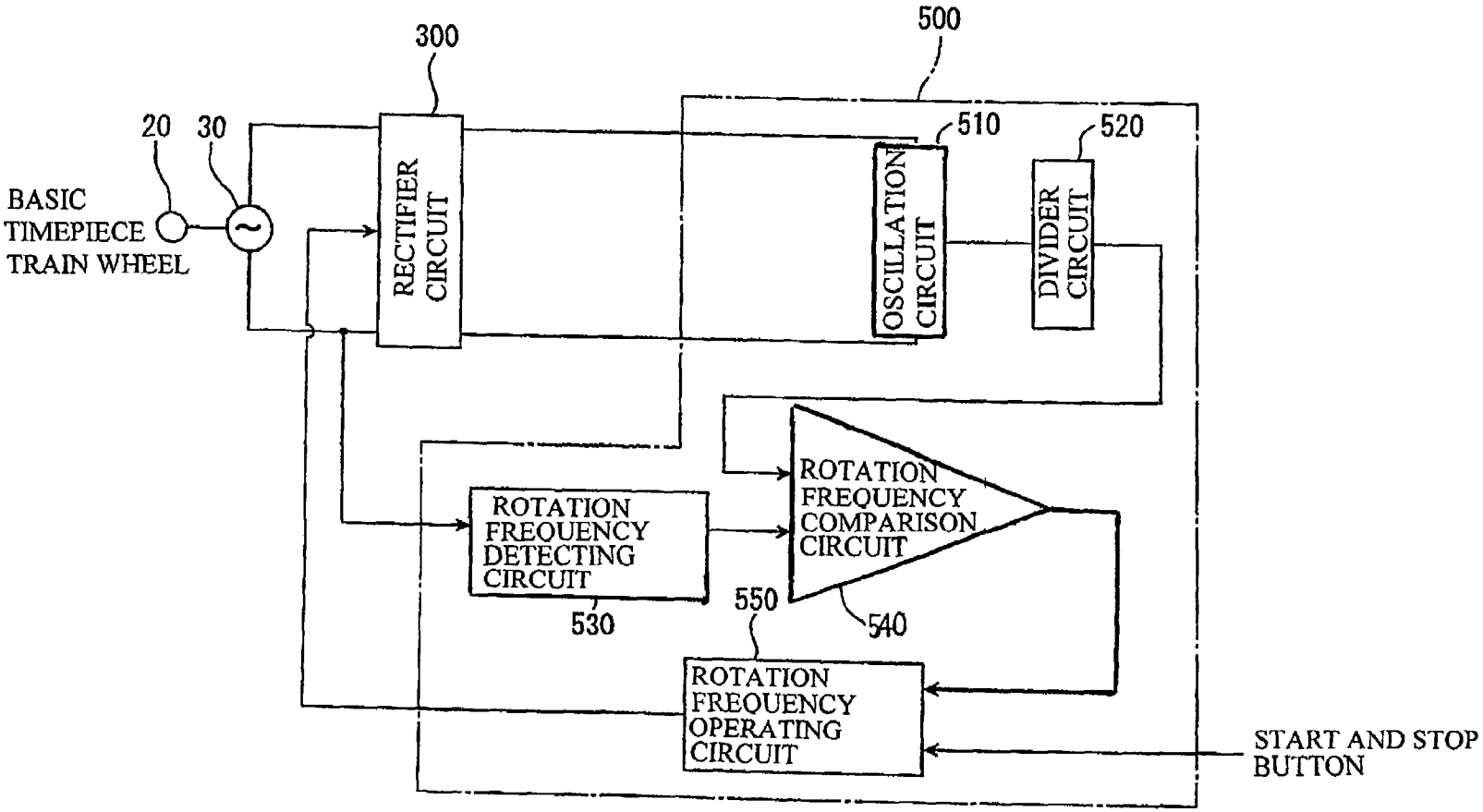
FIG. 6 is a block diagram showing the control device of the present-embodiment.

In FIG. 6, the IC 82, which is the control device, includes a rectifier circuit (rectifying section) 300 for converting the AC electric power from the power generator 30 into DC electric power, and a rotation frequency control unit 500 for controlling the rotation frequency of the rotor 31 provided to the power generator 30. The rotation frequency control unit 500 is connected to the secondary side of the rectifier circuit 300.

The rotation frequency control unit 500 is provided with an oscillation circuit 510 for generating a periodic signal with a crystal oscillator (not shown), a divider circuit 520 for dividing the periodic signal from the oscillation circuit 510 and outputting a standard periodic signal, a rotation frequency detecting circuit 530 for detecting the rotation frequency of the rotor 31 from the AC electric power of the power generator 30 and outputting a rotation frequency signal according to the rotation frequency of the rotor 31, a rotation frequency comparison circuit 540 for comparing the standard periodic signal from the divider circuit 520 and the rotation frequency signal from the rotation frequency detecting circuit 530, and a rotation frequency operating circuit 550 for outputting an operating signal to the rectifier circuit 300 on the basis of the comparison results of the rotation frequency comparison circuit 540.

The rotation frequency comparison circuit 540 includes an up/down counter for inputting the rotation frequency signal as an UP signal and inputting the standard periodic signal as a DOWN signal. The up/down counter is designed such that the counter value alternates between "17" and "16," for example, during normal pointer movement in which only the train wheel 20 is driven. When the standard periodic signal is inputted and the counter value becomes "16," the rotation frequency signal is then inputted and the counter value becomes "17," and a variation signal corresponding to the time difference therebetween is outputted to the rotation frequency operating circuit 550.

In addition to outputting an operating signal during normal pointer movement corresponding to the size of the variation signal, the rotation frequency operating circuit 550 also outputs a voltage conversion circuit for converting voltage as necessary, to be hereinafter described, so as to eliminate the variation between the rotation frequency signal and the standard periodic signal.

Figure 7:
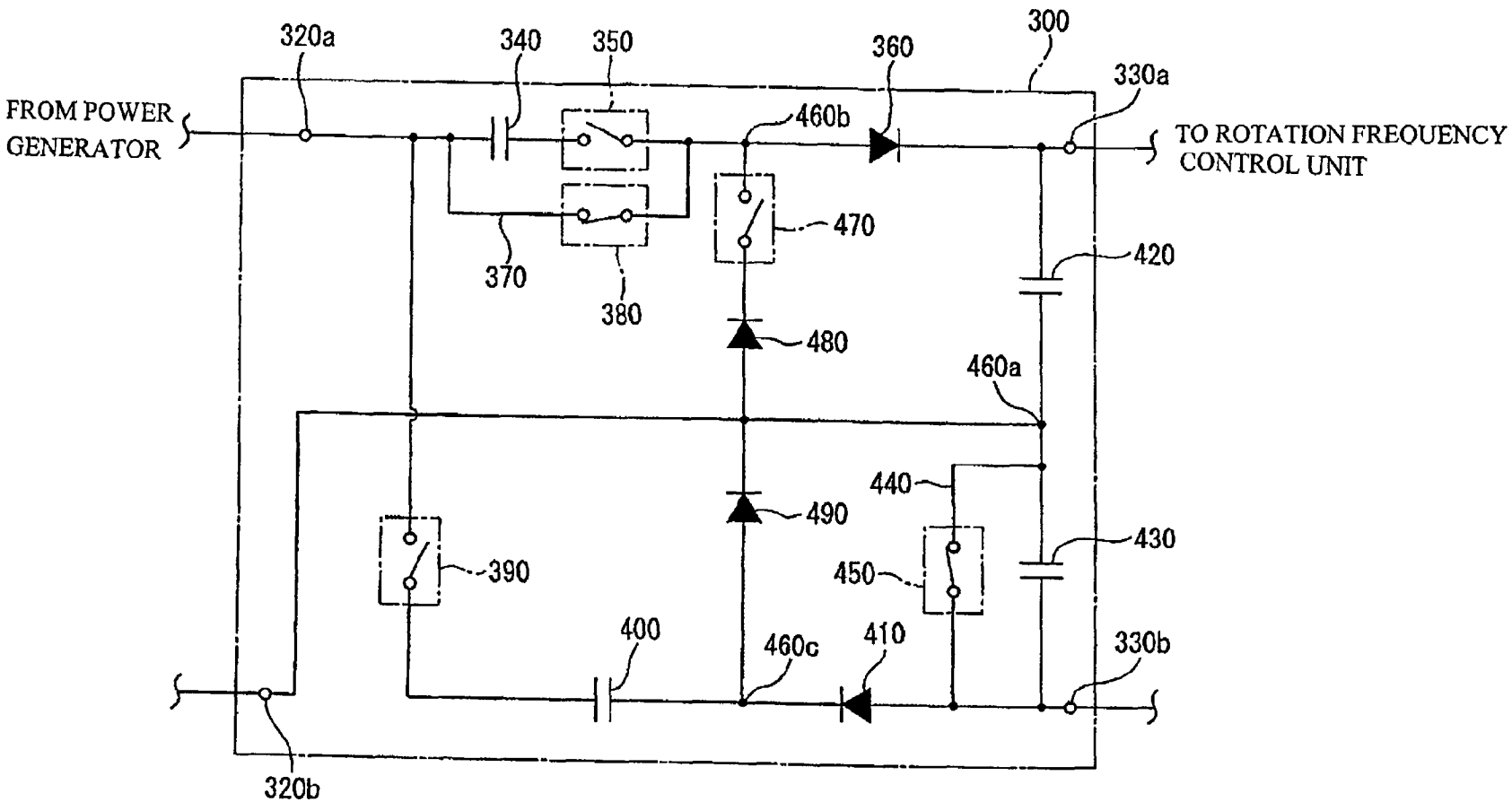
FIG. 7 is a circuit diagram showing the rectifier section of the present embodiment.

A specific example of the rectifier circuit 300 is shown in FIG. 7. The rectifier circuit 300 is capable of converting output voltage in three stages.

Specifically, in FIG. 7, the rectifier circuit 300 is provided with input terminals 320*a* and 320*b* to which the power generator 30 is connected, and output terminals 330*a* and 330*b* to which the rotation frequency control unit 500 or the like is connected.

A capacitor 340, a switching element 350, and a diode 360 are connected in series between the terminal 320*a* and the terminal 330*a*. The negative terminal of the diode 360 is connected to the terminal 330*a*.

A jumper circuit 370 for shorting the ends of the capacitor 340 and the switching element 350 is connected in parallel to the ends of both the capacitor 340 and the switching element 350. The jumper circuit 370 is provided with a switching element 380, and the switching element 380 closes to short the ends of the capacitor 340 and switching element 350.

A switching element 390, a capacitor 400, and a diode 410 are connected in series between the terminal 320*a* and the terminal 330*b*. The positive terminal of the diode 410 is connected to the terminal 330*b*.

Two capacitors 420 and 430 are connected in series between the terminal 330*a* and the terminal 330*b*. A jumper circuit 440 for shorting the ends of the capacitor 430 is connected in parallel to the ends of the capacitor 430. The jumper circuit 440 is provided with a switching element 450, and the switching element 450 closes to short the ends of the capacitor 430.

The terminal 320*b* is directly connected to a connecting point 460*a* between the capacitors 420 and 430, themselves provided between the terminal 330*a* and the terminal 330*b*.

The terminal 320*b* is also connected to a connecting point 460*b* between the switching element 350 and diode 360, themselves provided between the terminal 320*a* and terminal 330*a*, via a switching element 470 and a diode 480. The switching element 470 and diode 480 are connected in series, and the positive terminal of the diode 480 is connected to the terminal 320*b*.

Furthermore, the terminal 320*b* is connected to a connecting point 460*c* between the capacitor 400 and diode 410, themselves provided between the terminal 320*a* and terminal 330*b*, via a diode 490. The negative terminal of the diode 490 is connected to the terminal 320*b*.

Figure 8:
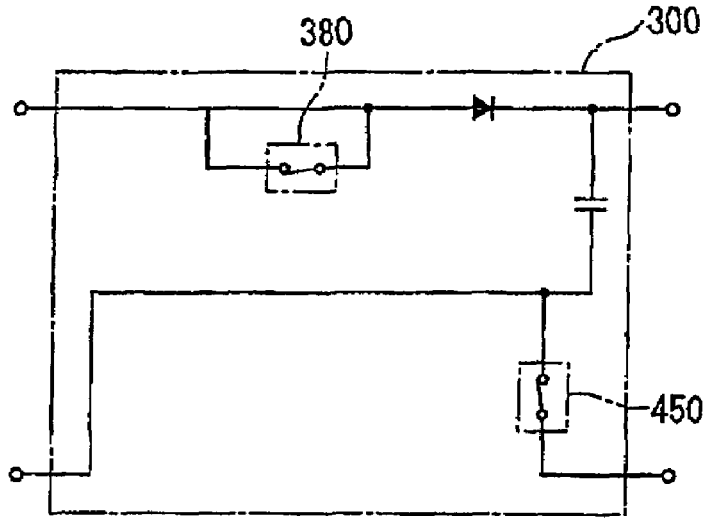
FIG. 8 is a first diagram for describing the switching of voltage in the rectifier section of the present embodiment.

When a specific voltage conversion signal and not an operating signal during normal pointer movement is inputted from the rotation frequency operating circuit 550, the switching elements 380 and 450 close and the switching elements 350, 390, and 470 open. In this state, the rectifier circuit 300 becomes a half-wave rectification system for rectifying half-waves of the AC voltage produced by the power generator 30, as shown in FIG. 8.

Figure 9:
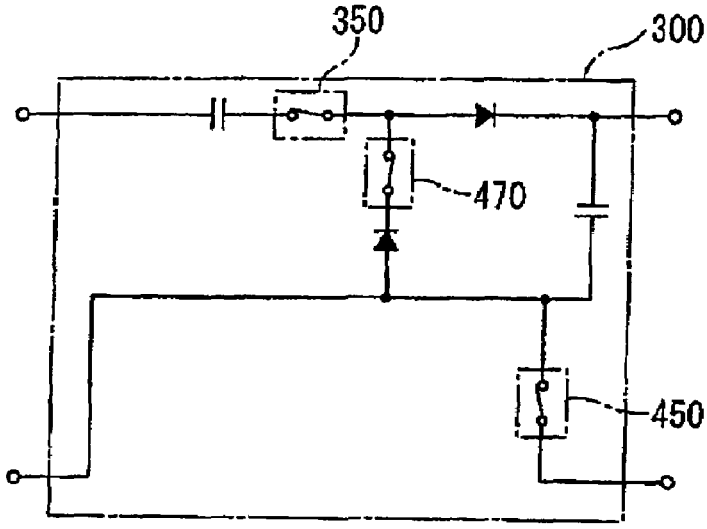
FIG. 9 is a second diagram for describing the switching of voltage in the rectifier section of the present embodiment.

Also, when another voltage conversion signal is inputted from the rotation frequency comparison circuit 540, the switching elements 350, 450, and 470 close and the switching elements 380 and 390 open. The rectifier circuit 300 in this state becomes a half-wave double rectification system in which the half-waves of the AC voltage produced by the power generator 30 are subjected to double rectification, as shown in FIG. 9. In this state, higher DC voltage is outputted and the winding electric current of the power generator 30 can be increased in comparison with a half-wave rectification system.

Figure 10:
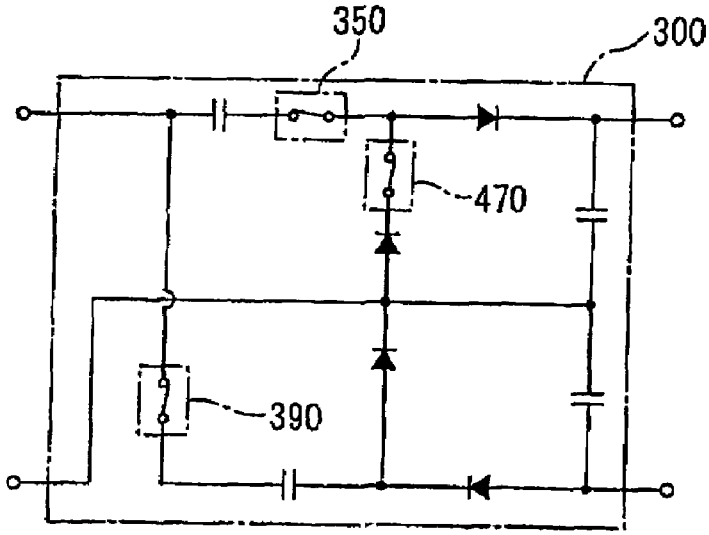
FIG. 10 is a third diagram for describing the switching of voltage in the rectifier section of the present embodiment.

Furthermore, when the operating signal during normal pointer movement is inputted from the rotation frequency comparison circuit 540, the switching elements 350, 390, and 470 close, and the switching elements 380 and 450 open. The rectifier circuit 300 in this state becomes a full-wave quadruple rectification system in which full waves of the DC voltage produced by the power generator 30 are subjected to quadruple rectification, as shown in FIG. 10. In this state, even higher DC voltage is outputted and the winding electric current of the power generator 30 can be further increased in comparison with a half-wave double rectification system.

In the present embodiment, when the rotor 31 of the power generator 30 rotates at a rotation frequency within a specific range; specifically, when the counter value is in a locked state of alternating between "17" and "16," the operating signal during normal pointer movement is outputted from the rotation frequency operating circuit 550, and the voltage conversion signal is not outputted. Accordingly, the rectifier circuit 300 functions as a full-wave quadruple rectification system, the winding electric current in the power generator 30 increases, and a damping force with a large brake torque is applied to the rotor 31 of the power generator 30.

When it is determined that the rotation cycle of the rotor 31 is very rapid on the basis of the input time difference between the rotation frequency signal and the standard periodic signal, the rotation frequency operating circuit 550 outputs an operating signal so as to extend the time in which the brake torque is applied while the rectifying system is maintained as a full-wave quadruple rectifying system, and the rotation cycle of the rotor 31 is kept constant.

By contrast, when the mainspring 10 unwinds and the driving torque for driving the train wheel 20 decreases, the variation between the rotation frequency signal and the standard periodic signal increases, which eventually results in a state in which the standard periodic signal is continuously inputted to the up/down counter of the rotation frequency comparison circuit 540. In this state, the counter value decreases and repeats between "16" and "15." This state is detected by the rotation frequency operating circuit 550, the rotation frequency operating circuit 550 presents the rectifier circuit 300 with an operating signal so that the damping time by the full-wave quadruple rectification system is reduced, and the rotation cycle of the rotor 31 continues to be kept constant.

In the multifunction timepiece 1, the drive energy for the CG train wheel 100 is transmitted from the train wheel 20, so the mechanical load on the train wheel 20 increases when the CG train wheel 100 is driven, the rotation speed of the rotor 31 driven by the train wheel 20 greatly decreases, and movement irregularities tend to occur in the second hand C or the like in the basic timepiece.

In view of this, the rotation frequency operating circuit 550 in the present embodiment is configured to receive an on/off signal correlated with the operation of the chronograph start and stop button 115, and when the chronograph is started and the start and stop button 115 is pressed to input an "on" signal, the counter value inputted from the rotation frequency comparison circuit 540 is forced to decrease in stages in the sequence "17"→"16"→"15"→"14," and is maintained at "14" during the start of the chronograph.

In this case, a voltage conversion signal that corresponds to each counter value is set in the rotation frequency operating circuit 550; for example, a signal for shortening the damping time is outputted to the rectifier circuit 300 while a full-wave quadruple rectification system is maintained at "16," a signal for switching the rectification system to a half-wave double rectification system is outputted and the brake torque applied to the rotor 31 is reduced at the stage wherein the counter value drops to "15," and a signal for switching to a half-wave rectification system is outputted and the brake torque is further reduced at "14." When the start and stop button 115 is pressed once again and an "off" signal is inputted, the counter value inputted from the rotation frequency comparison circuit 540 is raised in the sequence "14"→"15"→"16"→"17" opposite from the sequence described above, and the system returns to regular control.

Figure 11:
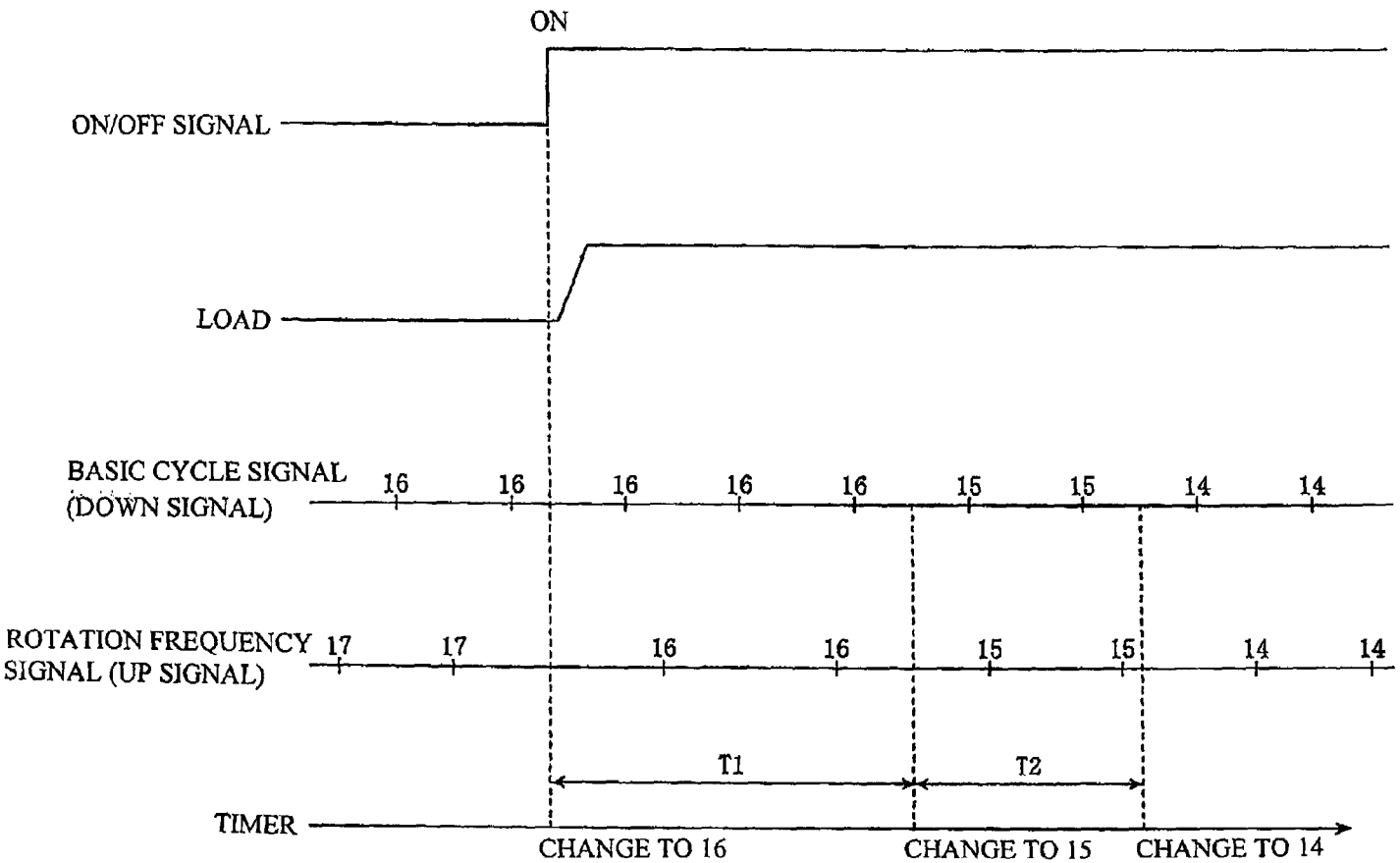
FIG. 11 is a first time chart for describing the control in the present embodiment.
Figure 12:
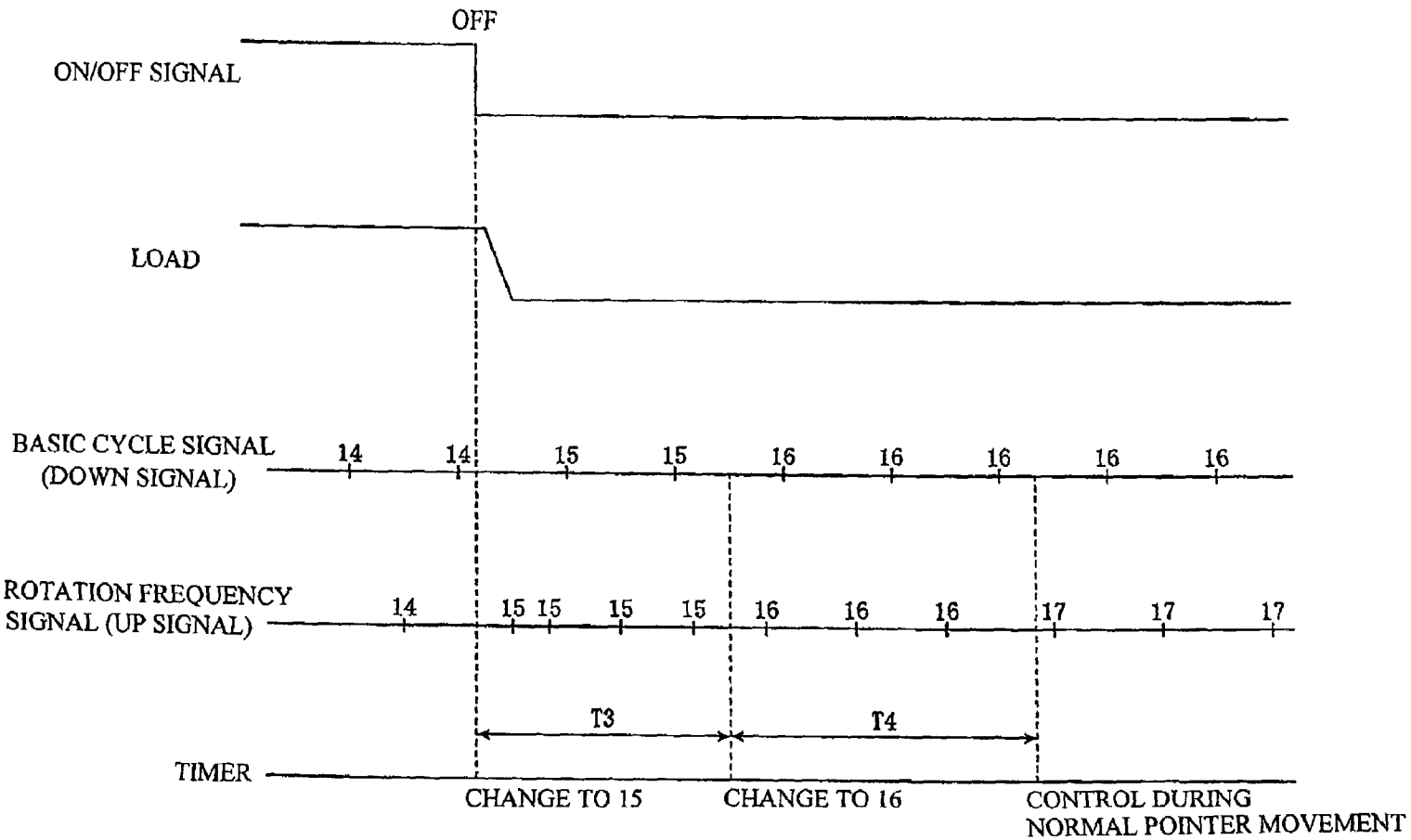
FIG. 12 is a second time chart for describing the control in the present embodiment.

Such control is described based on FIGS. 11 and 12.

In FIG. 11, when the chronograph is started by pressing the start and stop button 115 from a state of normal pointer movement wherein the counter alternates between "16" and "17," an "on" signal is inputted to the rotation frequency operating circuit 550, the counter value at this time is fixed at "16" regardless of the input of a basic cycle signal and a rotation frequency signal to the rotation frequency comparison circuit 450, and the load on the train wheel 20 increases.

The timer in the rotation frequency operating circuit 550 is then actuated, the counter value changes to "15" after a specific time T1 has passed, and the counter value changes to "14" after a time T2 has passed. The brake torque applied to the rotor 31 is thereby gradually reduced, so the rotation of the rotor 31 is kept constant in a stabilized state even when the load on the train wheel 20 increases.

When an "off" signal is inputted to the rotation frequency operating circuit 550 by pressing the start and stop button 115 again, the counter value at this time returns to "15," the load is reduced as shown in FIG. 12. The counter value returns to "16" after a specific time T3 has passed, and the control performed during regular pointer movement is restored and the system alternated between "17" and "16" after a time T4 has passed.

[Overall Structure of Electronically Controlled Mechanical Timepiece]

Figure 13:
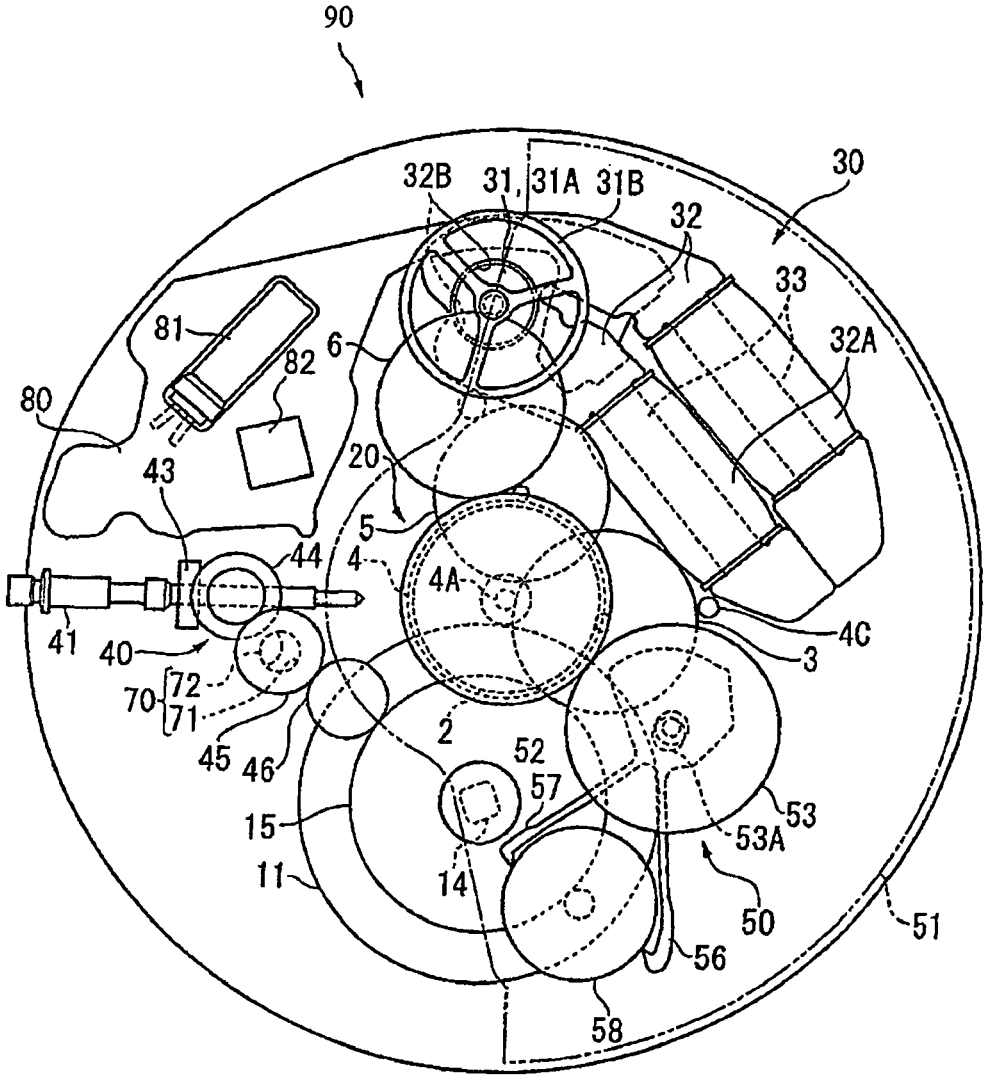
FIG. 13 is a plan view showing the basic outline of a movement for another timepiece included in the same series.

The electronically controlled mechanical timepiece 90 shown in FIG. 13 is a timepiece that has three visible pointers, and in terms of internal structure is similar to a timepiece in which the configuration relating to the chronograph function has been removed from the previously described multifunction timepiece 1. Therefore, the electronically controlled mechanical timepiece 90 includes a mainspring 10, a train wheel 20, a power generator 30, a manual input mechanism 40, and an automatic input mechanism 50, similar to the multifunction timepiece 1. Descriptions herein are omitted because the configurations of these elements are the same as in the multifunction timepiece 1. The stacked configuration of each layer is shown in a planar fashion in FIG. 6. Though not shown in the diagram, a small seconds wheel 4C or the like of the multifunction timepiece 1 is not provided because a second hand is mounted on the seconds wheel and pinion 4 in the electronically controlled mechanical timepiece 90.

The power generator 30 and circuit block 80 (including the IC 82) used herein are common electric components in both the electronically controlled mechanical timepiece 90 and the previously described multifunction timepiece 1. Specifically, since a mechanical resetting device that uses a resetting cam 120 is employed in the multifunction timepiece 1, a motor or another such electrical resetting device is not provided, and no type of motor is used at all because of the use of a speed adjustment device for adjusting the speed while the train wheel 20 is driven by the mainspring 10 and the rotation of the train wheel 20 is maintained. Nor is any motor or the like is used at all in the electronically controlled mechanical timepiece 90 because a speed adjustment device is used for adjusting the speed while the train wheel 20 is driven by the mainspring 10 and the rotation of the train wheel 20 is maintained. Therefore, unlike in conventional practice, in which different numbers of motors are used, it is possible to use in the timepieces 1 and 90 both a power generator 30 and a circuit block 80 as speed adjustment devices configured only from electronic components. However, rectifier-type switching is not performed in the IC 82 because the electronically controlled mechanical timepiece 90 does not include a chronograph function, and fluctuations in the load on the train wheel 20 are small.

Also, the common components used in the present embodiments are not limited to the electronic components alone and also include mechanical components such as the mainspring 10, the train wheel 20, the manual input mechanism 40, and the automatic input mechanism 50. Components with a larger energy storage capacity may be used with consideration to the energy consumption when the CG train wheel 100 is driven, particularly for the mainspring 10 in the multifunction timepiece 1.

The Present Embodiments Have the Following Effects.

(1) Specifically, since the speed adjustment device used in the multifunction timepiece 1 adjusts the speed while maintaining the rotation of the basic timepiece train wheel 20 in a constant direction, the CG hands D, E, F, and the second hand C can perform a sweep movement without the drive speed of the train wheel 20 instantaneously becoming zero. Therefore, it is possible to confirm the measured time in quantitative units even if graduations 7A, 7D, and 7E are not provided to locations where the CG hands D, E, and F stop, which makes more accurate measurement possible. Also, the sweeping pointer movement eliminates the need for limits on the intervals (allocation of the graduations) between the graduations 7D on the dial 7, for example, so thinner graduations can be provided and the minimum measurable units can be made smaller.

(2) When the second CG wheel 101 is driven by the seconds wheel and pinion 4 in a sweeping pointer movement, the reversing plate 113 next to the seconds wheel and pinion 4 and the reversing ring 112 in contact therewith are continuously rotated at the same speed. Accordingly, the second CG wheel 101 can be driven by the train wheel 20 to overcome friction, friction and slipping between the reversing ring 112 and the reversing plate 113 are eliminated, and friction between the other members can be reduced.

Also, since the train wheel 20 continues to rotate in a constant direction, adequate impact resistance can be ensured, and it is possible to prevent the second hand C, the second CG hand D, or the like from moving nonuniformly as a result of reversed rotation during pointer movement. Consequently, the values indicated by the second CG hand D or the like can be accurately observed during timekeeping.

(3) In the multifunction timepiece 1, the train wheel 20 is driven by the mainspring 10, so the supply of mechanical energy can be automatically adjusted depending on whether the pointers A, B, and C alone are moving or whether the CG hands D, E, and F are moving as well, and needless energy consumption can be eliminated to improve energy efficiency.

(4) Since the electronic components used in the timepieces 1 and 90 also constitute the speed adjustment device, fewer components can be used through the sharing of these electronic components, and the cost of the timepieces 1 and 90 within the same series can be markedly reduced.

(5) Moreover, since the IC 82, the circuit block 80 mounted thereon, and the power generator 30 are expensive electronic components, the cost can be greatly reduced by sharing these components.

(6) Components related to the CG function in the multifunction timepiece 1 are absent in the electronically controlled mechanical timepiece 90, and the mechanical components of the multifunction timepiece 1 can be shared with other mechanical components, whereby variety in components of the same series can be reduced and a further cost reduction achieved.

(7) Switching the rectification system to increase the output voltage of the rectifier circuit 300 increases the winding current of the power generator 30 in a stepwise manner. Accordingly, the damping force applied to the rotor 31 can be reduced in accordance with the speed reduction that accompanies the increased load on the rotor 31, the rotation frequency of the rotor 31 can be controlled with a high degree of precision, and time can be indicated with adequate precision.

(8) Moreover, damping based on the switching of the rectification system is different from damping based on the application of an electric current to a load resistance, and since the output voltage of the rectifier circuit 300 increases during damping, the input voltage of the rotation frequency control unit 500 decreases to a level equal to or less than the output level at which the rotation frequency control unit 500 normally operates, even when the voltage drop across the winding resistance of the power generator 30 increases and the output voltage of the power generator 30 decreases, whereby time can be indicated with adequate precision.

(9) Furthermore, with damping based on the switching of the rectification system, the voltage level of the rotation frequency control unit 500 can be maintained and the rotation frequency control unit 500 can operate normally even when external force is applied by impact or the like during damping and the rotation speed of the power generator 30 decreases. Accordingly, the size and weight of the entire multifunction timepiece 1 can be reduced and the time of continuous operation can be extended because there is no need to maintain the inertial mass of the rotor 31 to counter external forces.

(10) Also, switching elements 350, 380, 390, 450, and 470 are provided for switching the connection of the capacitors 340, 400, 420, and 430 and the diodes 360, 410, 480, and 490, which are the electric elements constituting the rectifier circuit 300, and rectification systems with different output voltages can be formed by switching the connections of these elements. Accordingly, a plurality of rectification systems can be assembled using a minimum number of electric elements, and the size of the timepiece can be reduced even in a design in which the rectification systems can be switched.

(11) When the chronograph is started up, the rotation frequency operating circuit 550 in the IC 82 lowers the inputted counter value of the up/down counter to "14" and reduces the brake torque applied to the rotor 31, so the rotation of the rotor 31 can be kept constant and the second hand C or the like can be made to move more uniformly even when the load on the train wheel 20 increases.

(12) At this time, the counter value is not reduced from "17" to "14" in a single operation but is lowered in steps through "16" and "15," making it possible to suppress sudden fluctuations in brake torque and allowing pointer movement to be made more uniform in this regard as well.

The present invention is not limited to the previously described embodiments and includes other configurations that allow the objects of the present invention to be achieved, and modifications and the like as illustrated below are also included in the present invention.

For example, a speed adjustment device that uses the power generator 30 and IC 82 was employed in the multifunction timepiece 1 of the embodiments previously described, but the train wheel 20 may also be driven using a constant-speed motor, in which case the train wheel can be driven while continuous rotation is maintained in a constant direction, and friction can be reduced in the area occupied by the reversing mechanism 10. In such a situation, the constant-speed motor is used as both a drive source and a speed adjustment device for the train wheel 20.

However, when a constant-speed motor is used, the drive of the CG train wheel 100 must be taken into account and the train wheel 20 must be constantly driven with a high output torque even when the CG train wheel 100 is not being driven, resulting in the needless consumption of the battery or the like and bringing about reduced economic efficiency. Therefore, it is more preferable for the train wheel 20 to be driven by the mainspring 10 or another such mechanical energy storage device, whereby the effects in (2) of the previously described embodiment can be obtained.

The timepieces 1 and 90 in the previously described embodiments differ by whether they have or do not have a CG function, but they are both electronically controlled mechanical timepieces included in the same series, and are designed to share many electronic components and mechanical components. However, the electronic components and mechanical components in such timepieces 1 and 90 may be designed and employed separately for each of the timepieces 1 and 90.

The rectifier section in accordance with the present invention is not limited to an element switching type wherein the electronic elements of the rectifier section are switched with the aid of switching elements to allow rectification systems with different output voltages to be formed, and may also be a circuit switching type having a plurality of rectifier circuits that serve as rectification systems each of which has a different output voltage, and also having switching elements for switching the connections to these rectifier circuits.

If such a circuit-switching rectifier section is employed, switching elements for switching the plurality of rectifier circuits as such may be provided for switching the output voltage. Accordingly, the number of switching elements is reduced, the number of switching elements that operate during the switching operation decreases, and the speed of the switching operation can be increased.

Also, the circuit-switching rectifier section is not limited to a rectifier circuit in which the output voltage can be switched in three stages between a half-wave rectification system, a half-wave double rectification system, and a full-wave quadruple rectification system, and may also be a rectifier circuit that can be switched between a double rectification system, a triple rectification system, and a full-wave quadruple rectification system.

In addition, the preferred configurations, methods, and the like for carrying out the present invention are disclosed in the above descriptions, but the present invention is not limited thereto. Specifically, the present invention is particularly illustrated and described primarily with reference to specific embodiments, but those skilled in the art can make various modifications to the shapes, materials, quantities, and other specific details of the embodiments described above without deviating from the scope of the technical ideas and objects of the present invention.

The terms "front," "back, "up,""down,""perpendicular," "horizontal," "slanted," and other direction-related terms used above indicate the directions in the diagrams used. Therefore, the direction-related terminology used to describe the present invention should be interpreted in relative terms as applied to the diagrams used.

"Substantially," "essentially," "about," and other terms that are used above and represent an approximation indicate a reasonable amount of deviation that does not bring about a considerable change as a result. Terms that represent these approximations should be interpreted so as to include a minimum error of about±5%, as long as there is no considerable change due to the deviation.

The disclosures in Japanese Patent Application No. 2003-155878 are incorporated herein in their entirety by reference.

The embodiments described above are only some of possible embodiments of the present invention, but it is apparent to those skilled in the art that it is possible to add modifications to the above-described embodiments by using the above-described disclosure without exceeding the range of the present invention as defined in the claims. The above-described embodiments furthermore do not limit the range of the present invention, which is defined by the accompanying claims or equivalents thereof, and are designed solely to provide a description of the present invention.

What is claimed is:

1. A timepiece comprising:

basic timepiece pointers being configured to rotate to indicate the standard time;

secondary time information pointers being configured to rotate to indicate secondary time information other than the standard time;

a mechanical energy storage section being made of a mainspring;

a train wheel being mounted between the mechanical energy storage section and the pointers to transmit energy from the mechanical energy storage section to the pointers, the train wheel being configured to be continuously rotated by the mechanical energy storage section, the train wheel having a reversing mechanism being configured to select whether the energy in the mechanical energy storage section is transmitted to the secondary time information pointers;

a power generator having a rotor being arranged in the power generator and mechanically interlockingly connected to the train wheel to rotate, and to generate power upon receiving energy from the mechanical energy storage section; and a control section being configured to control the rotation cycle of the rotor, being energized and driven by the electric power produced by the power generator, control section being configured to control the rotation cycle by adjusting the brake torque applied to the rotor, and to control the direction in which the brake torque is reduced when the secondary time information pointers are being driven.

2. The timepiece according to claim 1, wherein the secondary time information is chronograph information.

3. The timepiece according to claim 2, further comprising a resetting mechanism that is connected to the secondary time information pointers and has a flat heart-shaped resetting cam.

4. The timepiece according to claim 1 wherein the reversing mechanism has a spring member, a reversing ring mounted on the outer periphery of the spring member, a circular plate-shaped reversing plate with which the reversing ring comes into contact, and a chronograph coupling lever separating the reversing ring from the reversing plate.

5. The timepiece according to claim 4, further comprising a start and stop button connected to the chronograph coupling lever.

6. The timepiece according to claim 1, wherein the power generator further has a stator interlinking magnetic fluxes in relation to the rotor, and coils converting the flux variations in the stator into electric power.

7. The timepiece according to claim 6, wherein the control section has a rectifier section that converts AC voltage produced by the power generator and that is configured to output DC voltages with different voltages in multiple stages by switching a rectification system, and a rotation frequency control section configured to switch the rectification system of the rectifier section according to the rotation frequency of the rotor.

8. The timepiece according to claim 7, wherein the rotation frequency control section has a crystal oscillating circuit configured to create a specific periodic signal, a divider circuit configured to divide the periodic signal from the oscillating circuit and outputting a standard periodic signal, a rotation frequency detecting circuit configured to detect the rotation frequency of the rotor on the basis of the AC electric power from the power generator and to output a rotation frequency signal according to the rotation frequency of the rotor, a rotation frequency comparison circuit configured to compare the standard periodic signal and the rotation frequency signal, and a rotation frequency operating circuit configured to output an operating signal to the rectifier section on the basis of the comparison results of the rotation frequency comparison circuit.

9. The timepiece according to claim 7, wherein the rectifier section is configured to be configured to vary the voltage supplied to the power generator in three stages by a half-wave rectification system, a half-wave double rectification system, and a full-wave quadruple rectification system, and to be configured to vary the brake torque applied to the rotor.

10. The timepiece according to claim 1, wherein the mechanical energy storage section has a winding stem connected to the mainspring to wind up manually the mainspring.

11. The timepiece according to claim 10, further comprising an automatic input mechanism connected to the mainspring and provided with an oscillating weight.

12. A timepiece comprising:

basic timepiece pointers being configured to rotate to indicate the standard time;

secondary time information pointers being configured to rotate to indicate secondary time information other than the standard time;

a mechanical energy storage section;

a train wheel being mounted between the mechanical energy storage section and the pointers to transmit energy from the mechanical energy storage section to the pointers;

a power generator having a rotor connected to the train wheel to rotate, and to generate power upon receiving energy from the mechanical energy storage section;

a control section being configured to control the rotation cycle of the rotor, being energized by the electric power produced by the power generator, the control section having a rectifier section being configured to convert AC voltage produced by the power generator and to output DC voltages with different voltages in multiple stages by switching a rectification system, and a rotation frequency control section being configured to switch the rectification system of the rectifier section according to the rotation frequency of the rotor, the rotation frequency control section having a crystal oscillating circuit being configured to create a specific periodic signal, a divider circuit being configured to divide the periodic signal from the oscillating circuit and outputting a standard periodic signal, a rotation frequency detecting circuit being configured to detect the rotation frequency of the rotor on the basis of the AC electric power from the power generator and to output a rotation frequency signal according to the rotation frequency of the rotor, a rotation frequency comparison circuit being configured to compare the standard periodic signal and the rotation frequency signal, and a rotation frequency operating circuit being configured to output an operating signal to the rectifier section on the basis of the comparison results of the rotation frequency comparison circuit and a start and stop button for secondary time information, the rotation frequency operating circuit being configured to receive an on/off signal correlated with the operation of the start and stop button, and to lower forcibly in a stepwise fashion the value inputted from the rotation frequency comparison circuit to reduce the brake torque on a stator of the power generator upon receiving an "on" signal when pressing the start and stop button.

13. The timepiece according to claim 12, wherein the rotation frequency operating circuit is configured to raise forcefully and progressively the value inputted from the rotation frequency comparison circuit to strengthen the brake torque on the stator upon receiving an "on" signal when the start and stop button is pressed.

14. A stopwatch comprising:

chronograph pointers being configured to rotate to indicate chronograph time;

a mechanical energy storage section being made of a mainspring;

a train wheel being configured to transmit energy from the mechanical energy storage section to the chronograph pointers, mounted between the mechanical energy storage section and the chronograph pointers, the train wheel being configured to be continuously rotated by the mechanical energy storage section, the train wheel having a reversing mechanism being configured to select whether the energy in the mechanical energy storage section is transmitted to the secondary time information pointers;

a power generator having a rotor being arranged in the power generator and mechanically interlockingly connected to the train wheel to rotate, and to generate power upon receiving energy from the mechanical energy storage section; and a control section being configured to control the rotation cycle of the rotor, being energized and driven by the electric power produced by the power generator, control section being configured to control the rotation cycle by adjusting the brake torque applied to the rotor, and to control the direction in which the brake torque is reduced when the secondary time information pointers are being driven.

15. The stopwatch according to claim 14, wherein the control section controls the rotation cycle by adjusting the brake torque applied to the rotor.

16. The stopwatch according to claim 15, wherein the power generator further has a stator to interlink magnetic fluxes in relation to the rotor, and a pair of coils to convert the flux variations in the stator into electric power.

17. The stopwatch according to claim 16, wherein the control section has a rectifier section that converts AC voltage produced by the power generator and that is configured to output DC voltages with different voltages in multiple stages by switching the rectification system, and a rotation frequency control section configured to switch the rectification system of the rectifier section according to the rotation frequency of the rotor.

18. The stopwatch according to claim 17, wherein the rotation frequency control section has a crystal oscillating circuit to create a specific periodic signal, a divider circuit to divide the periodic signal from the oscillating circuit and outputting a standard periodic signal, a rotation frequency detecting circuit to detect the rotation frequency of the rotor on the basis of the AC electric power from the power generator and to output a rotation frequency signal according to the rotation frequency of the rotor, a rotation frequency comparison circuit to compare the standard periodic signal and the rotation frequency signal, and a rotation frequency operating circuit to output an operating signal to the rectifier section on the basis of the comparison results of the rotation frequency comparison circuit.

19. A timepiece comprising:

basic timepiece pointers being configured to rotate to indicate the standard time;

secondary time information pointers being configured to rotate to indicate secondary time information other than the standard time;

a mechanical energy storage section being made of a mainspring;

a train wheel being mounted between the mechanical energy storage section and the pointers to transmit energy from the mechanical energy storage section to the pointers, the train wheel being configured to be continuously rotated by the mechanical energy storage section, the train wheel having a reversing mechanism being configured to select whether the energy in the mechanical energy storage section is transmitted to the secondary time information pointers;

a power generator having a rotor being arranged in the power generator and mechanically interlockingly connected to the train wheel to rotate, and to generate power upon receiving energy from the mechanical energy storage section; and a control section being configured to control the rotation cycle of the rotor, being energized and driven by the electric power produced by the power generator, the control section controlling the rotation cycle by adjusting the brake torque applied to the rotor, and also controlling the direction in which the brake torque is reduced when the secondary time information pointers are being driven.

20. The timepiece according to claim 19, wherein the control section controls the rotating speed of the rotor.

21. The timepiece according to claim 20, wherein the rotor and the pointers operate simultaneously.

22. The timepiece according to claim 21, wherein the generator and the pointers are driven by power from the mechanical energy storage section.

* * * * *